US010018013B2

(12) United States Patent
Love

(10) Patent No.: US 10,018,013 B2
(45) **Date of Patent: *Jul. 10, 2018**

(54) METHOD AND APPARATUS FOR TREATING A WELL

(71) Applicant: Texian Resources, Granbury, TX (US)

(72) Inventor: Douglas N. Love, Granbury, TX (US)

(73) Assignee: Texian Resources, Granbury, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/676,387

(22) Filed: Aug. 14, 2017

(65) Prior Publication Data

US 2017/0342801 A1 Nov. 30, 2017

Related U.S. Application Data

(60) Continuation of application No. 14/861,383, filed on Sep. 22, 2015, now Pat. No. 9,732,586, which is a division of application No. 13/605,298, filed on Sep. 6, 2012, now Pat. No. 9,163,494.

(51) Int. Cl.

| | |
|---|---|
| ***E21B 43/26*** | (2006.01) |
| ***E21B 34/06*** | (2006.01) |
| ***E21B 43/10*** | (2006.01) |
| *E21B 34/00* | (2006.01) |

(52) U.S. Cl.

CPC ..... *E21B 34/06* (2013.01); *E21B 43/103* (2013.01); *E21B 43/26* (2013.01); *E21B 2034/002* (2013.01)

(58) Field of Classification Search

CPC ..... E21B 43/26; E21B 43/103; E21B 43/108; E21B 43/10; E21B 43/101; E21B 43/105; E21B 43/106; E21B 23/01; F16K 1/465

See application file for complete search history.

(56) References Cited

U.S. PATENT DOCUMENTS

| | | | |
|---|---|---|---|
| 2,986,214 | A | 5/1961 | Wiseman |
| 4,292,988 | A | 10/1981 | Montgomery |
| 4,756,363 | A | 7/1988 | Lanmon |
| 7,134,505 | B2 | 11/2006 | Fehr et al. |
| 7,322,417 | B2 | 1/2008 | Rytlewski |
| 7,350,582 | B2 | 4/2008 | McKeanchnie et al. |
| 7,681,654 | B1 | 3/2010 | Cugnet |
| 2001/0050172 | A1 | 12/2001 | Tolman et al. |
| 2003/0102127 | A1 | 6/2003 | Braddick |
| 2006/0124311 | A1 | 6/2006 | Lopez De Cardenas |

(Continued)

OTHER PUBLICATIONS

USPTO Notice of Allowance for U.S. Appl. No. 14/861,383 dated Apr. 10, 2017.

(Continued)

*Primary Examiner* — Robert E Fuller
*Assistant Examiner* — David Carroll
(74) *Attorney, Agent, or Firm* — Tumey L.L.P.

(57) ABSTRACT

A tool for forming a valve seat within a well that is capable of catching an obstruction will prevent flow of fluid downstream of the seat. The seat is formed by expanding a sleeve with a ring positioned around its periphery or as a subsequent step in the process. As the sleeve is expanded over the ring, the seat is formed. Once the seat is formed, an obstruction in the form of a ball or dart is dropped down to the seat. The sleeve acts as a stop for a secondary valve seat which catches the obstruction.

9 Claims, 2 Drawing Sheets

(56) References Cited

U.S. PATENT DOCUMENTS

| | | | | |
|---|---|---|---|---|
| 2006/0131031 | A1 | 6/2006 | McKeachnie et al. | |
| 2007/0159351 | A1* | 7/2007 | Madhavan | E21B 17/003 340/855.1 |
| 2010/0252252 | A1 | 10/2010 | Harris et al. | |
| 2010/0276159 | A1 | 11/2010 | Mailand et al. | |
| 2011/0192607 | A1* | 8/2011 | Hofman | E21B 34/14 166/317 |
| 2011/0240295 | A1 | 10/2011 | Porter et al. | |
| 2013/0062063 | A1 | 3/2013 | Baihly et al. | |
| 2014/0014371 | A1 | 1/2014 | Jacob et al. | |
| 2014/0060837 | A1 | 3/2014 | Love | |

OTHER PUBLICATIONS

USPTO Notice of Abandonment for U.S. Appl. No. 14/015,618 dated Jun. 2, 2016.
Non-Final Office Action for U.S. Appl. No. 14/015,618 dated Oct. 22, 2015.
Non-Final Office Action for U.S. Appl. No. 13/605,298 dated Apr. 23, 2015.
USPTO Notice of Allowance for U.S. Appl. No. 13/605,298 dated Jun. 18, 2015.
International Search Report and Written Opinion for PCT/US13/58183 dated Apr. 16, 2014.

* cited by examiner

METHOD AND APPARATUS FOR TREATING A WELL

This application is a continuation application of U.S. application Ser. No. 14/861,383 filed Sep. 22, 2015, which is a divisional application of U.S. patent application Ser. No. 13/605,298, filed on Sep. 6, 2012, which are herein incorporated by reference in their entirety.

BACKGROUND OF INVENTION

1. Field of the Invention

The invention disclosed and claimed in this application relates to the treatment of oil and/or gas wells. One example of such treatment is commonly referred to as fracturing the formulation around an oil or gas well. Fluid with certain chemical additives and a proppant are injected into the formation surrounding either a vertical or horizontal well to form cracks or passageways in the formation to stimulate the production of the well.

2. Description of Related Art

Currently there are several techniques utilized to stimulate producing of a well by fracing. Typically a packer or plug is utilized to isolate a particular portion of the well and the fracing fluid is injected into the isolated portion under high pressure. Once a given portion of the well is treated in this manner, a second zone uphole of the first zone is isolated by a second packer or plug that cuts off flow to the downhole portion of the well that has been treated.

U.S. Pat. No. 7,322,417 discloses a plurality of vertically spaced production layers 1 and a plurality of valves 14. A ball is captured on a valve seat 94 which will cause an increase in pressure to open valve 14. This allows fracturing fluids to enter the annular region that surrounds the valve. The balls may be formed of a dissolvable or frangible material, which allows the ball to be dissolved or eroded to open up communication upstream through the casing.

U.S. Pat. No. 7,134,505 discloses a similar system in which a plurality of spaced apart packers 20 *a-n* and a plurality of valve bodies 26 *c-n* that capture balls of varying diameters to selectively open ports 16 *c-e* to allow fracturing fluids to flow into the isolated zones.

Stage frac methods include the use of pump down bridge plugs, perforating guns, and sliding sleeves. The current pump down method requires a drill out phase after frac with coiled tubing or jointed pipe. This is an expensive and time consuming process which involves additional risk of the coil tubing getting stuck in the wellbore. This time and operational risk is a significant impact item on the overall economics of oil and gas projects.

Sliding sleeves require that their exact position needs to be known as the casing is run into the well. The number of frac initiation points is limited and the cost is significant for each sleeve. Sleeves may malfunction either during opening or closing. Higher risk comes from incomplete frac distribution and limited reservoir drainage.

BRIEF SUMMARY OF THE INVENTION

The present invention overcomes the difficulties with the prior art as described above by using proven concepts and a simplified approach. An expansible valve seat or stop member that can be run on wireline (pump-down, tractor, tubing or coiled tubing) is positioned at predetermined locations along the casing and is expanded for example by a shaped charge or with a mandrel extrusion process. A disintegrating or dissolvable ball can be dropped in the valve seat to isolate a portion of the well to allow for fracturing of the isolated portions of the well. The seat may be made of the same material as the ball so that the drill out step is completely eliminated.

The ball and valve seat become the frac plug that would normally be pumped down in a conventional horizontal pump-down process.

The casing can be perforated as in the pump down method and fracing can be initiated once the ball seals on the valve seat. A dart may be used in lieu of a ball. Balls, darts, seats or sleeves may be soluble, dissolvable or frangible.

BRIEF DESCRIPTION OF THE SEVERAL VIEWS OF THE DRAWING(S)

DETAILED DESCRIPTION OF THE INVENTION

As described below, the invention of this application is directed to a novel process of fracturing a plurality of zones in the formation surrounding a horizontal or vertical well without the use of multiple bridge plugs or frac plugs that require drill out after the fracturing process is complete prior to the production stage.

Figure 2:
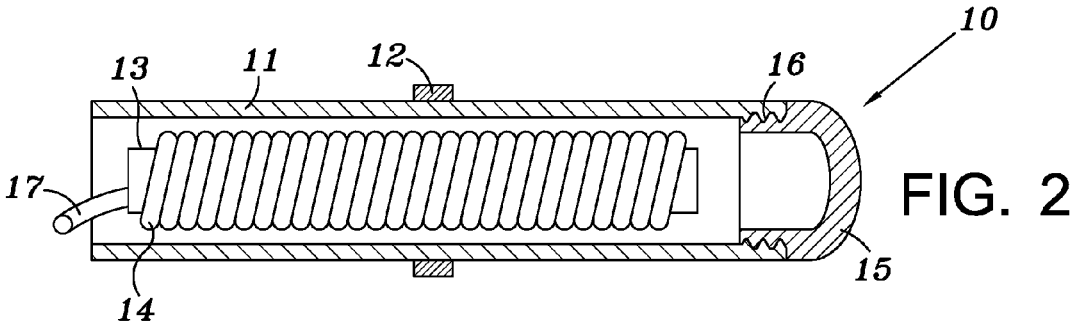
FIG. 2 is a cross sectional view of expansible sleeve seat according to an embodiment of the invention.
Figure 5:
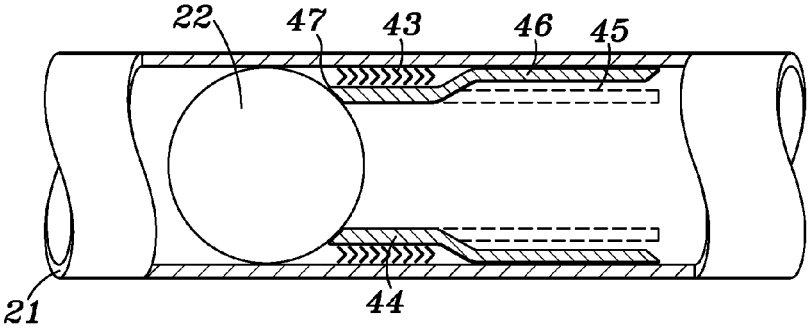
FIG. 5 is a cross-sectional view of a third expansible sleeve seat with ball.

This is accomplished in the following manner. After the well has been drilled (51) and the casing has been fully positioned (52), an expansible sleeve such as shown in FIG. 2 is placed at the desired location within the casing (53). As shown in FIG. 2, the expansible sleeve 10 consists of a relatively thin walled cylindrical tube 11 formed of a high tensile strength material similar to that of the well casing 21. A ring of expansible material 12 may surround a portion of tube 11. A cap 15 is positioned over the downhole end 16 of the tube so that the expansible sleeve 10 may be pumped into the well. The outside diameter of the ring 12 is slightly less that the inside diameter of the casing. Detonation cord 14 is wound about a frangible mandrel 13 positioned within the tube and includes an electrical cord 17 for detonation. Another embodiment of this patent may employ the use of an extrusion process using a mandrel and sleeve to create the seat as shown in FIG. 5. The resultant sleeve or seat installed in the casing will be the same whether the installation process is expansive or extruded.

Figure 3:
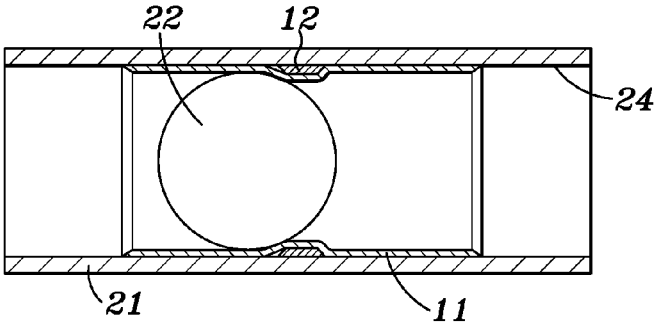
FIG. 3 is a cross-sectional view of the sleeve seat deployed within the casing with ball.
Figure 4:
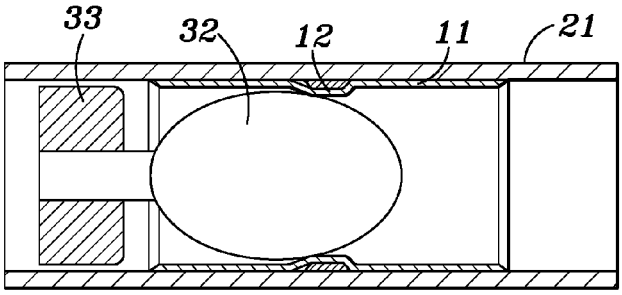
FIG. 4 is a cross-sectional view of a second expansible sleeve seat with dart.

Expansible sleeve 10 may be precisely positioned within the casing by any suitable known technique such as a line counter or collar locator. Once positioned within the desired location of the casing, the cord is detonated causing the sleeve to expand outwardly against the inner surface of the casing (54). In so doing, the sleeve forms a seat 12 as shown in FIG. 3 which is capable of catching and retaining a ball or dart as shown in FIG. 3 and FIG. 4 that is pumped down.

The outer surface of tube 11 may be impregnated with a thin strip of no slip high strength metallic material.

Once the tube 11 and seat have been set in place, the casing and cement (if present) in the first frac zone can be perforated (55) in the conventional way by a perforating gun on the same tool-string as the expansible sleeve. At this point the tool-string can be removed, and the fracing process can be initiated by pumping down (56) a ball or dart to rest against seat 12. This will prevent the fracing fluid from flowing downhole and will cause the fracing fluid under pressure (57) to enter the formation surrounding the perforations in the casing and thus commence the fracing process.

Figure 1:
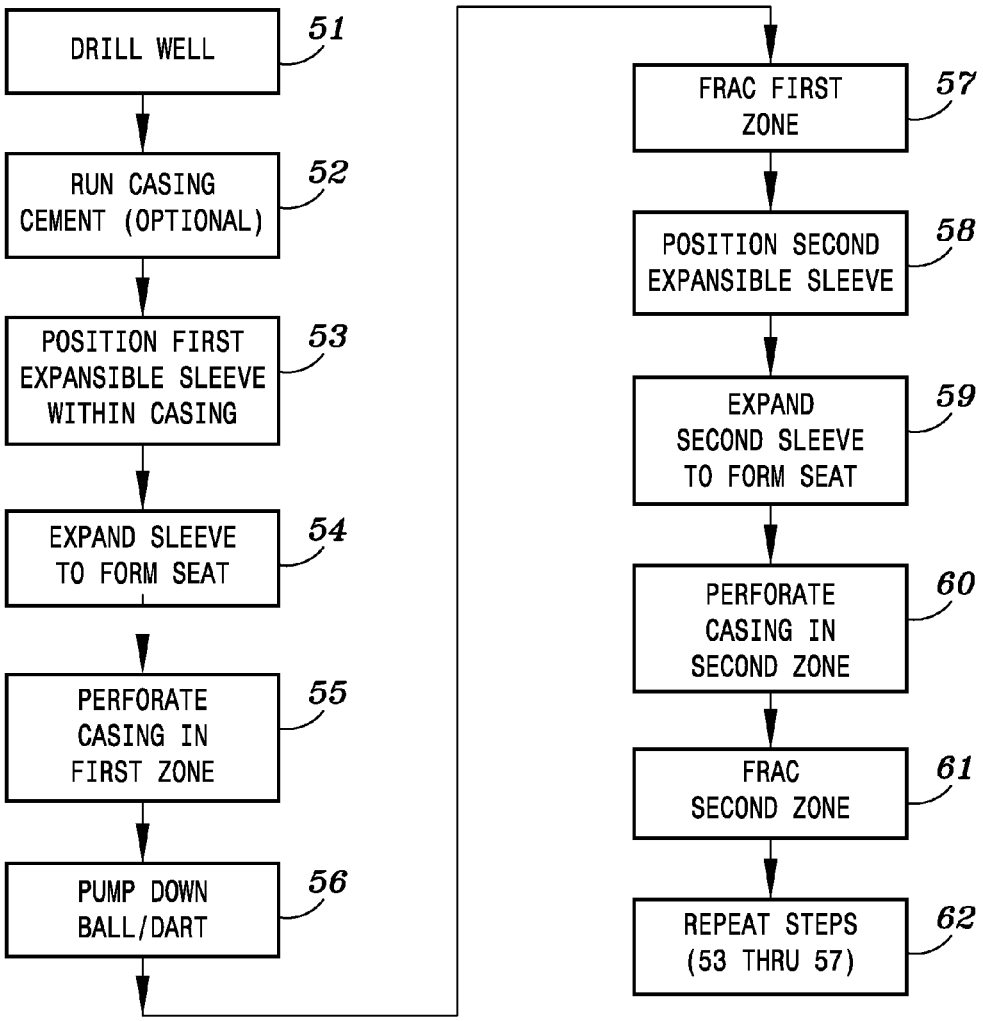
FIG. 1 is a flow diagram of the process according to an embodiment of the invention.

Once the process is completed for the first zone, a second expansible sleeve can be placed (58) to isolate a second zone and the process can be repeated (59-62) for as many zones as desired as indicated in FIG. 1. The ball, dart, seat or sleeve may be made of a soluble, dissolvable, or frangible material such that it would not be necessary to drillout the sealing mechanism after fracturing. The ball, dart, seat or sleeve would shrink in size or completely dissolve so that the constituents went into solution or were flowed back with the frac load water.

Another embodiment of the expansible sleeve is illustrated in FIG. 5. In this embodiment, a tubular member is shown in an unexpanded condition at 45. Chevron or swellable seals 43 are positioned about an uphole portion 44 of the sleeve 45. Sleeve portion 45 is expanded by a mandrel or shaped charge into the position indicated at 46 against the inner surface of the casing 21. In this embodiment the uphole portion 44 of the sleeve may have a beveled surface (47) against which ball 22 rests when a ball or dart is pumped down into the casing.

Figure 6:
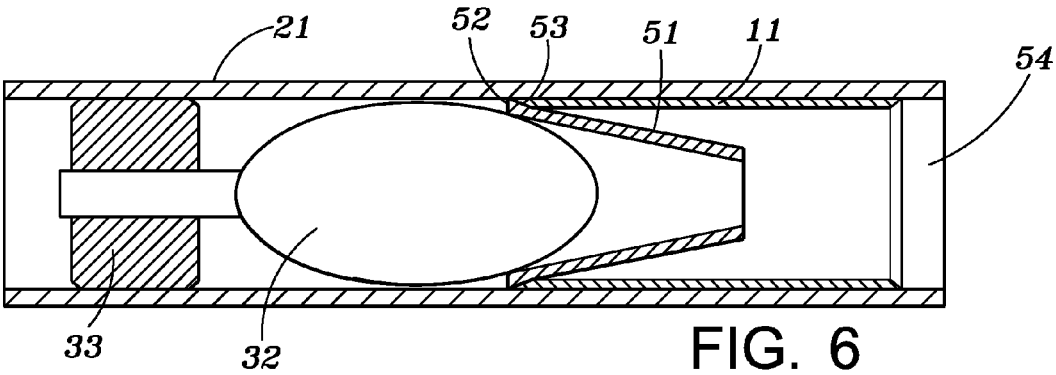
FIG. 6 is a cross-sectional view of a fourth embodiment with an expansible sleeve and separate seat with dart.

An additional embodiment of the expansible sleeve is illustrated in FIG. 6. In this embodiment, a sleeve 11 is expanded in the casing 21 and used as a stop or no-go for a secondary conical seat 51 that is either simultaneously or subsequently placed on the no-go. The perforations are then added. A ball or dart 32 is then landed on the seat forming the sealing mechanism for the wellbore and the stage is frac'd. Secondary seat 51 may have an elastomeric annular seat 52 that engages a tapered portion 53 of the sleeve 11 to form a seal. This process can be repeated as many times as necessary to adequately stimulate the formation surrounding the wellbore. The ball, dart or seat in this embodiment may also be made of a soluble, dissolvable, or frangible material.

The expandable sleeve may be formed of steel for example J-55 or similar steel. The wall thickness may vary from approximately 0.095 inches to about 0.25 inches. The diameter of the sleeve is selected to be slightly smaller than that of the well casing so for example if the casing is 5½ inch casing, the sleeve may have an outside diameter of 4.5 inches.

Although the present invention has been described with respect to specific details, it is not intended that such details should be regarded as limitations on the scope of the invention, except to the extent that they are included in the accompanying claims.

I claim:

1. A tool for forming a valve seat within the casing of an oil and/or gas well capable of capturing an obstruction to thereby prevent flow of fluids downhole of the valve seat comprising:

a. a sleeve formed of expansible material, said sleeve adapted to engage an inner surface of the casing;

b. a valve seat formed as part of the sleeve; and c. a ring member surrounding the sleeve; wherein the valve seat is formed by expanding the sleeve over the ring.

2. The tool for forming a valve seat as claimed in claim 1 further including a thin strip of no-slip metallic material impregnated on an outer surface of the sleeve.

3. The tool for forming a valve seat as claimed in claim 1 further including a cap closing a downhole portion of the sleeve so that the tool can be pumped down into the well to a predetermined location.

4. The tool for forming a valve seat as claimed in claim 1 further including an explosive charge positioned within the sleeve to expand the sleeve when the charge is detonated.

5. The tool for forming a seat as claimed in claim 4 further comprising a frangible mandrel supporting the explosive charge.

6. The tool for forming a seat as claimed in claim 4 wherein the explosive charge is detonation cord.

7. The tool as claimed in claim 2 wherein the thin strip of no-slip metallic material includes an elastomeric sealing agent.

8. The tool as claimed in claim 1 wherein the ring is positioned around the sleeve approximately at the midpoint of the sleeve.

9. The tool as claimed in claim 1 wherein the ring has an outer diameter approximately equal to the inner diameter of a production tubular within the well.

* * * * *